US005213706A

United States Patent [19]

Rapisarda et al.

[11] Patent Number: 5,213,706

[45] Date of Patent: May 25, 1993

[54] HOMOGENEOUS DETERGENT GEL COMPOSITIONS FOR USE IN AUTOMATIC DISHWASHERS

[75] Inventors: Anthony A. Rapisarda, Elmhurst, N.Y.; Robert J. Corring, Rockaway Township, Morris County; Gail B. Rattinger, Teaneck, both of N.J.

[73] Assignee: Lever Brothers Company, Division of Conopco, Inc., New York, N.Y.

[21] Appl. No.: 790,280

[22] Filed: Nov. 8, 1991

[51] Int. Cl.[5] ..... C11D 3/04

[52] U.S. Cl. ..... 252/135; 252/156; 252/173; 252/174.23; 252/DIG. 2; 252/DIG.4

[58] Field of Search ..... 252/135, 156, 173, 174.23, 252/DIG. 2, DIG. 14

[56] References Cited

U.S. PATENT DOCUMENTS

| | | | |
|---|---|---|---|
| 3,337,468 | 8/1967 | Metcalf et al. | 252/132 |
| 3,390,093 | 6/1968 | Feierstein et al. | 252/135 |
| 3,720,621 | 3/1973 | Smeets | 252/135 |
| 3,793,212 | 1/1974 | Gray et al. | 252/99 |
| 3,812,045 | 5/1974 | Gray et al. | 252/99 |
| 4,116,849 | 9/1978 | Leikhim | 252/103 |
| 4,260,528 | 4/1981 | Fox et al. | 252/525 |
| 4,302,348 | 11/1981 | Requejo | 252/135 |
| 4,390,441 | 6/1983 | Beavan | 252/96 |
| 4,431,559 | 2/1984 | Ulrich | 252/99 |
| 4,464,281 | 8/1984 | Rapisarda et al. | 252/174.21 |
| 4,512,908 | 4/1985 | Heile | 252/160 |
| 4,556,504 | 12/1985 | Rek | 252/135 |
| 4,740,327 | 4/1988 | Julemont et al. | 252/103 |
| 4,752,409 | 6/1988 | Drapier et al. | 252/94 |
| 4,836,948 | 6/1989 | Corring | 252/99 |
| 4,859,358 | 8/1989 | Gabriel et al. | 252/99 |
| 4,933,101 | 6/1990 | Cilley et al. | 252/99 |
| 4,941,988 | 7/1990 | Wise | 252/99 |
| 4,973,419 | 11/1990 | Romeo et al. | 252/135 |
| 4,988,456 | 1/1991 | Takahashi et al. | 252/314 |
| 5,053,158 | 10/1991 | Dixit et al. | 252/99 |
| 5,089,162 | 2/1992 | Rapisarda et al. | 252/102 |

FOREIGN PATENT DOCUMENTS

| | | |
|---|---|---|
| 239379 | 9/1987 | European Pat. Off. . |
| 0398021 | 11/1990 | European Pat. Off. . |
| 0091471 | of 0000 | German Democratic Rep. . |
| 0137679 | of 0000 | Netherlands . |
| 2163448A | 2/1925 | United Kingdom . |
| 1320919 | 6/1973 | United Kingdom . |
| 2007253 | 5/1979 | United Kingdom . |

OTHER PUBLICATIONS

Monsanto Marketing Technical Service Information, Apr., 1990 ed. pages unknown.

Monsanto Detergents & Phosphates—Produce Data Sheet Oct. 1990 pages unknown.

Monsanto SHMP Technical—Product Data Sheet Jun. 1983 pages unknown.

FMC—Formulation Guidelines for Heavy Duty Liquid Detergents date and pages unknown.

Sodium Trimetaphosphate—Monsanto's Fluff Detergent Process/A Low Energy, Low Capital Alternative for Detergent Manufacture pages unknown.

*Primary Examiner*—Asok Pal
*Assistant Examiner*—P. Achutamurthy
*Attorney, Agent, or Firm*—A. Kate Huffman

[57] ABSTRACT

A homogeneous liquid detergent composition comprising sodium trimetaphosphate, potassium hydroxide and an alkali metal silicate, the composition being substantially free of added potassium salts with a K/Na weight ratio of less than 1 and preferably in a gel form.

9 Claims, No Drawings

HOMOGENEOUS DETERGENT GEL COMPOSITIONS FOR USE IN AUTOMATIC DISHWASHERS

FIELD OF THE INVENTION

The present invention relates to homogeneous stable gel detergent dishwashing compositions based on builders which do not require the use of potassium salts for solubility.

BACKGROUND OF THE INVENTION

Liquid detergents for automatic dishwashers have been commercialized since the mid 1980's and have overcome many problems encountered with automatic dishwasher detergent powders. Powdered detergents lose solubility on aging, cake in the dispenser cup especially if the builder used in the formulation is an insufficiently hydrated sodium tripolyphosphate, and dusting is generated by fine particles upon dispensing.

Automatic dishwashing liquids (ADL's) which are structured with thixotropic clays, such as the bentonites, solved many of the powder problems but tended to separate on aging. Additionally, such clay thickened ADL's if not shaken prior to pouring increased significantly in viscosity of the residual liquid so that the last few ounces in the container could not be readily decanted. See U.S. Pat. Nos. 4,116,849 (Leikham); 4,431,559 (Ulrich); and 4,740,327 (Julemont et al.). Formulation of clay structured products with stabilizers, such as polyvalent metal salts, has been disclosed in U.S. Pat. No. 4,752,409 (Drapier et al.).

Gel-structured liquid detergent formulations were thus developed to overcome the deficiency of clay structured products. Such gel detergents do not require shaking and deliver a uniform dosage of each ingredient from the first to last use. When properly formulated to appropriate viscosity, such a gel product could be dispensed almost completely and cleanly from the container. Clear detergent compositions with non-drip properties are obtained by using potassium carbonate and/or potassium pyrophosphate as builders of choice to achieve clarity as described in U.S. No. 4,836,948 (Corring).

Many factors must be considered in selecting a builder for use in detergents as discussed in van Wazer, J. "Phosphorus and it Compounds" Volume 2, Interscience Publishers, Inc. (New York, 1958). These factors include alkalinity, pH, buffering ability, water softening, stability and cost effectiveness. For liquid and gel formulations, phosphate builders which are highly soluble and reversion stable are required.

Tetrapotassium pyrophosphate is a preferred builder for clear liquid and gel detergent formulations because of its solubility characteristics. Tetrapotassium pyrophosphate is, however, deficient in water softening relative to tripolyphosphate because it is a poorer sequestrant. If insufficient pyrophosphate is present such as when used in hard water, highly insoluble pyrophosphate precipitates will form. The ability of pyrophosphate to complex ions lies intermediate between the orthophosphates and the higher polyphosphates.

The use of small amounts of a polyelectrolyte such as sodium polyacrylate have been used in combination with the pyrophosphate builder to improve its effectiveness in hard water as described in EP 239,379. Another method of improving hard water effectiveness for liquid detergents is to use a sodium tripolyphosphate (STPP) builder. However, given the relatively low solubility of STPP in water, its use in homogeneous liquid formulations is limited. A more expensive alternative to achieve a homogeneous gel composition is the use of potassium tripolyphosphate as a builder.

The use of potassium salts in a liquid composition built with STPP allows the STPP within the compositions to attain a higher solubility then in the absence of potassium as disclosed in U.S. No. 3,720,621 (Smeets). The potassium salts are added to these formulations to provide a source of potassium ion.

Another polyphosphate that has been used in the art to produce homogeneous liquid detergent compositions is a glassy phosphate which has an $Na_2O/P_2O_5$ mole ratio of 1.6 to 0. One such glassy polyphosphate is sodium hexametaphosphate. Hexametaphosphate has an $Na20/P_2O_5$ ratio of about 1.1. Its chemical formula is

$$Na_{n+2}P_nO_{3n+1}$$

wherein n is 13 to 18 as described in Monsanto Chemical Company's product sheet entitled "Sodium hexametaphosphate" (June 1983), Publication No. 9047.

Other glassy polyphosphates are infinitely soluble in water, but they are not useful as builders in liquid detergents partially because of hydrolysis forming crystalline sodium phosphate which comes out of the solutions upon standing. See van Wazer, J. "Phosphorus and its Compounds", Volume 2, Interscience Publishers, Inc. (N.Y., 1958), page 1762.

Sodium trimetaphosphate has been described as a builder useful for making a homogeneous liquid detergent. Its ability to complex metal ions is not sufficiently strong to be of commercial value; however, when the trimetaphosphate anion is hydrolyzed in a strongly alkaline solution, sodium tripolyphosphate is formed. van Wazer, J., "Phosphorus and its Compounds", Volume 1, Interscience Publication, Inc. (N.Y., 1958) Pages 456 , 462, 641 and 704. Moreover, it is known that to prepare a mixed salt (Na/K) tripolyphosphate, sodium trimetaphosphate is hydrolyzed with caustic potash to form sodium potassium tripolyphosphate as follows:

$$(NaPO_3)_3 + 2\ KOH = Na_3K_2P_3O_{10} + H_2O$$

| STMP | Caustic Potash | SKTP | Water |
|---|---|---|---|

The foregoing reaction is hydrolyzed in a temperature range of from 45° C. to 70° C. In performing this reaction, the maximum solids content should not exceed 38% because sodium ions are most detrimental to the solubility of sodium potassium tripolyphosphate. Therefore, sodium ions should be avoided while potassium salts should be chosen. Monsanto Chemical Company, Marketing Technical Service Information Bulletin (April, 1990).

U.S. No. 5,053,158 (Dixit et al.) combines a builder salt selected from the polyphosphates including alkali metal tripolyphosphate, alkali metal pyrophosphates and alkali metal metaphosphate, with silicate, alkali metal hydroxide, chlorine bleach stable organic detergent active, thickening agent and a long chain fatty acid or its metal salt. According to Dixit et al. the thickening agent and fatty acid components must be present in order to maintain the stability of the compositions. The sodium and potassium ions must be present in a K/Na weight ratio of from about 1/1 to about 45/1. Potassium salts are used in Dixit et al. to solubilize the builders and provide the claimed homogenity.

SUMMARY OF THE INVENTION

It is therefore a object of the present invention to obtain a stable, free flowing, readily dispensable and homogeneous gel composition which does not require the use of potassium salts to solubilize the alkaline components.

Another object of the present invention is to provide a gel composition which will perform effectively in hard water without the use of additional sequestrants such as polyelectrolytes.

A further object is to provide an automatic dishwashing composition which utilizes soluble materials which will not crystallize upon standing. The composition according to the present invention further compatabilizes nonionic surfactant and a source of available chlorine.

Finally, it is an object of the present invention to provide a homogeneous, soluble gel composition in which the builder is more cost effective than formulations which depend upon the use of builders which are formulated with potassium salts.

The objects of the present invention are accomplished by providing the inventive liquid detergent compositions which do not depend on the use of potassium salts for solubility and which comprise from about 5 to 28 by weight of sodium trimetaphosphate; from about 3 to about 12% by weight of potassium hydroxide; from about 2 to about 20% by weight of an alkali metal silicate; and the balance of water.

Optional ingredients such as thickeners and stabilizers, bleach, nonionic surfactants colorants, dyes, pigments, perfumes, anti-tarnish agents, soil suspending agents, enzymes, hydrotropes & mixtures thereof are also included.

DETAILED DESCRIPTION OF PREFERRED EMBODIMENTS

In as much as the prime object of the present invention is to provide a soluble, homogeneous gel composition which does not require co-builders to perform effectively in hard water, the preferred builder is sodium trimetaphosphate. Sodium trimetaphosphate reacts in situ with the base to form a soluble tripolyphosphate.

The term "homogeneous" used to describe the inventive gel means a detergent composition in which substantially all of the alkaline components are soluble in the liquid phase with no sedimentation occurring.

Other builders known in the art are not suitable for this invention for the following reasons. Sodium pyrophosphate and sodium tripolyphosphate have limited solubility and therefore are unsuited for use by themselves in a homogeneous liquid detergent. Although potassium pyrophosphate and potassium tripolyphosphate are sufficiently soluble, pyrophosphates have been found to be deficient in softening hard water and the cost of potassium tripolyphosphate does not make it economically feasible to provide a reasonably priced consumer product. The use of sodium trimetaphosphate and potassium hydroxide as raw materials in the present invention produce formulations comparable in cost to those based on STPP builders, whereas tetrapotassium pyrophosphate and potassium tripolyphosphate double and triple the cost, respectively.

In detergent formulations requiring a combination of co-builders to improve efficiency in hard water, such as the combination of potassium pyrophosphate and a low amount of sodium tripolyphosphate alone or in combination with a dispersant polyelectrolyte, additional resources are required. For example, more equipment, a larger working area, additional monitoring of raw materials, etc. make formulations based on co-builders less desirable than detergent formulations utilizing a single builder.

Builders such as ammonium salts of the polyphosphate may be sufficiently soluble for such formulations but they cannot practically be utilized in alkaline formulas because ammonia will be volatilized. Such volatilization leads to pressure build-up in the container causing the container, which is usually plastic, to rupture.

The soluble glassy phosphates, such as sodium hexametaphosphate are not desirable builders since they are prone to crystallization.

According to the invention, the sodium trimetaphosphate builder is combined with potassium hydroxide to form homogeneous gel compositions. While sodium trimetaphosphate itself is not a sequestering agent, its reaction with the base converts the metaphosphate anion to the tripolyphosphate anion.

Sodium trimetaphosphate is preferably about 5 to about 28% by weight, more preferably about 8 to 20% by weight and especially 10–16% by wt of the composition. Potassium hydroxide is preferably about 3 to about 12% by weight, more preferably about 4 to about 10% by weight and especially preferred about 6 to about 8% by weight of the inventive composition.

Other bases known in the art are not desirable for the present invention because of the reaction with the metaphosphate anion. In particular, if sodium hydroxide is used for the hydrolysis, sodium tripolyphosphate which has a limited solubility is formed. Hydrolysis with an ammonium hydroxide base will form a soluble tripolyphosphate, but due to the loss of ammonia in alkaline solution, the use of ammonia hydroxide is limited to neutral or acidic formulations, rather than the alkaline compositions of the invention.

When sodium trimetaphosphate is hydrolyzed with potassium hydroxide, according to the invention, a soluble sodium potassium tripolyphosphate (SKTP) is formed as follows:

$$(NaPO_3)_3 + 2\ KOH = Na_3K_2P_3O_{10} + H_2O$$

The preferred reaction according to the invention is carried out by slurrying the sodium trimetaphosphate with water in a tank or mixing vessel. Potassium hydroxide is added in solid or aqueous form. If the aqueous form is used, it should be heated to about 45° C. The rate of addition of the potassium hydroxide should be controlled so that the temperature in the mixing vessel is between about 45° and about 70° C. Processes involving the reaction of sodium trimetaphosphate with alkali are discussed in the following art: Netherlands No. 137,679 describes drying of SKTP/alkali with other ingredients; German No. 91,471 describes reacting sodium trimetaphosphate with alkali at a temperature of between 60° to 100° C. to simultaneously produce crystal and product and mother liquor; and U.S. Pat. Nos. 3,812,045 and 3,793,212 describe the reaction of sodium metaphosphate and alkali in the presence of anionic surfactants.

The composition contains potassium and sodium ions in a wt. ratio of K/Na of less than one, and preferably from about 0.5 to about 0.9. It was surprisingly found that there was sufficient solubility of the alkaline components without the addition of potassium salts as a source of potassium to produce a useful product which remained stable for an extended period of time.

Silicates

Alkali metal silicates are employed as cleaning ingredients, as a source of alkalinity, metal corrosion inhibitor, and protector of overglaze on china tableware. An especially preferred silicate is sodium silicate having a ratio of $SiO_2$:$Na_2O$ of from about 1.0 to about 3.3, preferably from about 2 to about 3.2. While potassium silicate may be used in detergent formulations to provide an additional source of potassium ion to maintain homogeneity, sodium silicate is preferred since it is more effective. Accordingly, sodium silicate is preferably used in the invention in either solid or aqueous form, at a level in the range of about 2 to about 20%, more preferably from about 3 to about 15%.

Surfactants

Nonionic surfactants are generally preferred for use in automatic dishwasher detergents. Preferably, they should be of the defoaming type. Where appropriate, they can be used in an amount of from about 0.2 to about 8%, preferably from about 1 to about 4%. Nonionic synthetic detergents can be broadly defined as compounds produced by the condensation of alkylene oxide groups with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of the various chemical types suitable as nonionic surfactants include: polyoxyethylene and/or polyoxypropylene condensates of aliphatic carboxylic acids, aliphatic alcohols and alkyl phenols; polyoxyethylene derivatives of sorbitan mono -,di-, and tri-fatty acid esters and polyoxyethylene - polyoxypropylene block polymers as described in U.S. No. 4,973,419, herein incorporated by reference.

The incompatibility of many alkoxylated nonionios with chlorine bleach must be taken into consideration when liquid and gel compositions are formulated. Attempts have been made to improve compatibility of alkoxylated nonionics and chlorine bleach by "capping" the terminal hydroxyl group, as described in U.S. Pat. Nos. 4,859,358 (Gabriel), 4,988,456 (Takahashi) herein incorporated by reference.

Two alternative means of compatibilizing alkoxylates and chlorine bleach are: (1) to separate them in different compartments within a container for storage, and provide a means to combine them when they are dispensed for use, or (2) to encapsulate one of the materials. Encapsulation of chlorine bleach is preferably used in the present invention and is described more fully in the section on bleaches.

Since the nonionic is compatible with chlorine bleach in this invention, a wide variety of alkoxylates may be used. Particularly preferred are the defoaming nonionics such as those given in U.S. Pat. No. 4,973,419 in column 6, lines 28–50, herein incorporated by reference.

Bleach

A wide variety of halogen and peroxygen bleach sources may be used in the present invention. Examples of such halogen and peroxygen bleaches are described in U.S. Pat. No. 4,973,419 columns 4, and 5 herein incorporated by reference.

However, the bleach sources preferred for use in the present invention are those which can be encapsulated by the processes disclosed in co-pending applications S/N 688,691 (Kamel et al.) and S/N 688,692 (Lang et al.) herein incorporated by reference. Particularly preferred chlorine bleach sources include potassium, and sodium dichloroisocyanurate dihydrate. They should be present at a level which provides about 0.2 to about 1.5% available chlorine. Hypohalite liberating compounds may also be employed in the inventive dishwashing detergents at a level of from 0.5 to 5% by weight, preferably from 0.5 to 3%.

Some types of bleaches are not suitable for the present invention. For example, U.S. Pat. No. 4,390,441 discloses a composition which contains a halite, e.g., $NaClO_2$, which is relatively ineffective under alkaline conditions. Such a halite source is not acceptable for the present invention because in order to activate the halite it is necessary to irradiate the dispersed composition with ultra violet radiation for from 10 minutes to 10 hours, preferably, from about 30 minutes to 4 hours. Commercially available dishwashers are not presently available which provide a means for irradiating the dispersed composition with ultra violet light. If it were feasible to adapt current dishwashers to include a U.V. source, the halite would have limited utility. The length of the main wash cycle varies from as little as 4 to about 25 minutes, and about 35 percent of machines wash for less than 10 minutes. Aside from the time required to dissolve the capsules to liberate the halite, the bleach would not be optimally activated in the main wash.

Thickeners and Stabilizers

Thickeners for use in the homogeneous compositions according to the invention are disclosed in U.S. Pat. No. 4,836,948 (Corring) herein incorporated by reference. Particularly preferred thickeners are the cross-linked polymers having molecular weights ranging from about 500,000 to about ten million, preferably between 500,000 and 4,000,000. Examples of commercially available cross linked polymers are the Carbopol® resins manufactured by the B.F. Goodrich Chemical Company. These material include Carbopol 941® (m.w. 1,250,000) Carbopol 934® (m.w. 3,000,000), Carbopol 940® (m.w. 4,000,000) and Carbopol 617® (m.w. 4,000,000). Analogs provided by other manufacturers would also be useful. In the preferred embodiments, the chlorine bleach is encapsulated, thus polymers such as those disclosed in U.S. Pat. No. 4,260,528 (Fox et al.) may also be used.

The thickening polymer is present in the compositions in a range of 0 to about 3.0 by wt./ and preferably about 0.4% to about 1.5% by wt.

Co-structurants or stabilizers may also be used in combination with the thickeners. Examples of such preferred co-structurants and stabilizers include (1) alumina described in U.S. Pat. No. 4,836,948, (2) alkali metal silico aluminate described in U.S. Pat. No. 4,941,988, (3) polyvalent metal soaps, described in U.S. Pat. No. 4,752,409 (Drapier, et al.) and (4) a synthetic hectorite clay such as Laponite XLS supplied by Waverly Mineral Products Co., subsidiary of LaPorte,Inc., of Bala Cynwd, PA 19004.

Preferred constructurants include alumina and the hectorite clays. The constructurants may be used in a range of from about 0.005 to 1%; preferably about 0.01 to about 0.5%; and especially preferred about 0.01 to about 0.1%.

Optional Ingredients

Bleach stable colorants such as Direct Yellow 28 and others disclosed in co-pending patent application S/N 348,549, allowed Aug. 9, 1991 may be used in the present invention. Bleach sensitive dyes such as those described in U.S. Pat. No. 4,464,281 (Rapisarda, et al.) may also be used in the preferred embodiments containing encapsulated bleach. Alternatively, pigments such as Ultramarine Blue 5151 or Ultramarine Blue 17 may also be used. Greater latitude in the selection of perfume ingredients is provided because destabilization by chlorine is not a factor. If additional defoaming is desired, silicones such as a polydimethyl siloxane with 6% hydrophobed silica supplied as Antifoam DB-100® by Dow Corning of Midland, MI may be used. Minor amounts of other ingredients such as anti-tarnish agents, soil suspending agents, hydrotropes, etc. may also be included in the inventive formulations. The amount of each optional additive is no greater than about 0.5% by weight.

The following examples will serve to distinguish this invention from the prior art, and illustrate its embodiments more fully. Unless otherwise indicated, all parts, percentages and proportions referred to are by weight.

EXAMPLES 1-4

Sodium trimetaphosphate was hydrolyzed with three (3) different bases and the effects were observed. Specifically four (4) formulations were prepared containing sodium trimetaphosphate, sodium silicate and water in combination with three (3) bases: potassium hydroxide, ammonium hydroxide, and sodium hydroxide as illustrated in Examples 1-4.

It was observed that the hydrolysis products formed with potassium and ammonium hydroxide (Examples 1, 2) were soluble, however, due to volatilization of ammonia in the pH range (9-13.5) of the invention the ammonium salt cannot be used. In Example 3, sodium hydroxide reacted with the sodium trimetaphosphate. The formed sodium tripolyphosphate had limited solubility and was observed as a precipitated sediment in the formulation.

Example 4 illustrates that the addition of potassium hydroxide to sodium tripolyphosphate (wherein the level of the tripolyphosphate anion concentration was about equal to that which results by hydrolyzing 13.3% sodium trimetaphosphate with KOH) did not solubilize the sodium tripolyphosphate and a very heavy precipitate was observed.

| | Examples | | | |
|---|---|---|---|---|
| | 1 | 2 | 3 | 4 |
| Sodium Trimetaphosphate | 13.3 | 13.3 | 13.3 | — |
| Sodium Tripolyphosphate | — | — | — | 16.0 |
| Potassium Hydroxide | 6.6 | — | — | 6.6 |
| Ammonium Hydroxide | — | 4.3 | — | — |
| Sodium Hydroxide | — | — | 4.7 | — |
| Sodium Silicate, 2.4 r | 12.0 | 12.0 | 12.0 | 12.0 |
| Water | | | to 100% | |
| Precipitate After 24 hours | None | None | Heavy | V. Heavy |

EXAMPLE 5-9

The following 5 formulations were prepared to illustrate the effect of adding polyphosphate built formulas, as well as an embodiment according to the invention, to hardened water.

The formulas in Examples 5-9 were prepared by dissolving or slurrying the phosphates in water, followed by the addition of the other ingredients. One liter of deionized water was added to each of five 1500 ml beakers which contained magnetic stirring bars. Four grams of the formulations of Examples 5-9 were transferred individually to correspondingly marked beakers. A stock solution was made to contain 10 ppm hardness having a calcium to magnesium ion ratio of 2 to 1 per milliliter. This solution was poured into a 50 ml buret, and examples 5-9 were "titrated" with the hardened water until a permanent turbidity persisted or precipitation occurred. The number of milliliters of hardened water required to attain permanent turbidity or precipitation was recorded as the end point. The milliliters of titrant was recorded and converted to parts per million of water hardness expressed as calcium carbonate required to sequester 4.0 grams of the respective formulations. These determinations were converted to ppm hardness required to sequester one mole of builder, and ppm hardness required to sequester one mole total builder anion used. These results are tabulated in Table 1.

| | Examples | | | | |
|---|---|---|---|---|---|
| | 5 | 6 | 7 | 8 | 9 |
| Tetrapotassium Pyrophosphate | 15.00 | 10.8 | 10.8 | — | — |
| Sodium Tripolyphosphate | — | 3.0 | 3.0 | 16.0 | — |
| Sodium Trimetaphosphate | — | — | — | — | 13.3 |
| Sodium Polyacrylate | — | — | 0.45 | — | — |
| Potassium Hydroxide | — | — | — | — | 5.1 |
| Sodium Silicate, 2.4 r | 5.9 | 5.9 | 5.9 | 5.9 | 5.9 |
| Water | 79.1 | 80.3 | 79.85 | 78.1 | 75.7 |

TABLE 1 ppm Hardness to Titrate 4.0 Gm of Examples 5-9

| Example No. | Builder Wt. (gm) | $Ca^{++}$ (ppm) | ppm $Ca^{++}$/ gm Builder | Mols Builder $\times 10^{-4}$ | ppm $Ca^{++}$/ Mol Builder $\times 10^{4}$ | Mol Wt. % Anion $\times 10^{-4}$ | ppm $Ca^{++}$/ Mol Wt. % Anion $\times 10^{4}$ |
|---|---|---|---|---|---|---|---|
| 5 | 0.600 | 157 | 261.6 | 18.16 | 8.64 | 9.56 | 16.42 |
| 6 | 0.552 | 152 | 275.4 | 16.34 | 9.30 | 9.12 | 16.66 |
| 7 | 0.570 | 170 | 198.2 | 16.37 | 10.38 | 9.15 | 18.58 |
| 8 | 0.640 | 222 | 346.9 | 17.40 | 12.76 | 11.96 | 18.55 |
| 9 | 0.727 | 239 | 328.7 | 17.40 | 13.74 | 11.00 | 21.72 |

Table 1 shows that the weight of hardness sequestered per mole weight percent of anion builder using the tripolyphosphate anion is the most effective as seen in Example 9. On this basis, Example 5 which contains only pyrophosphate builder anion is least effective. The combination of 10.8% pyrophosphate and 3% tripolyphosphate for a total of 13.8% combined builders in Example 6 provides a slight improvement versus 15% pyrophosphate used in Example 5. In Example 7, 0.45% sodium polyacrylate was added to Example 6. Some difficulty is encountered in titrating systems which contain polyacrylate with $Ca^{++}/Mg^{++}$, because the polymer is an excellent dispersant. Should this occur, the dispersing power of the polymer can mask the end point for the first excess of precipitate formed will be readily dispersed and the visual end point will be higher than stoichiometric. The net effect is, however, the precipitate will remain suspended and not deposit on surfaces. Example 8 nominally contains an equivalent amount of tripolyphosphate anion as Example 9, but Example 9 clearly has a higher tolerance for $Ca^{++}$. This difference may be explained on the basis that the tripolyphosphate used is a technical grade and as such contains pyrophosphate and orthophosphate in addition to the tripolyphosphate.

EXAMPLES 10–13

Two embodiments according to the invention were prepared and their formulations, along with the ratio of potassium to sodiumions, re presented as Examples 10–11 below. The sodium ion from the bleach is not included since it si not "available" until the encapsulate coating dissolves in the temperatures of the wash water. Three electrolyte solids level in Example 10 is 32% and in Example 11 and 41.5% and showed no instability after about 2 months storage at room temperature and 105° F.

| | Examples | |
|---|---|---|
| | 10 | 11 |
| Sodium Trimetaphosphate | 13.3 | 25.0 |
| Sodium Silicate, 2.4 r | 12.0 | — |
| Sodium Silicate, 2.0 r | — | 5.7 |
| Carbopol 940 | 0.90 | 0.90 |
| Sulfuric Acid | 0.006 | 0.006 |
| Clearon CDB 56[a] | 1.35 | 1.35 |
| Paraffin Wax | 1.336 | 1.336 |
| Hercolyn D[b] | 0.014 | 0.014 |
| Nonionic[c] | 2.0 | 2.0 |
| Potassium Hydroxide | 6.7 | 10.8 |
| Fragrance | 0.10 | 0.10 |
| Laponite XLS | 0.02 | 0.02 |
| Direct Yellow 28 | 0.003 | 0.003 |
| Water | to 100% | to 100% |
| $K^+/Na^+$ Ratio (Wt. %) | 4.669/5.617 | 7.525/7.047 |
| $K^+/Na^+$, Normalized | 0.831 | 1.068 |

[a]sodium dichloroisocyanurate dihydrate supplied by Owen Chemical Company of Hartford, CT
[b]synthetic resin-methyl ester of partially hydrogenated resin from Hercules, Inc. of Wilmington, DE
[c]polytergent SLF-18 supplied by Owen Chemical Company of Hartford, CT Examples 10 and 11 were prepared by first formulating a premix (Premix 1) which contained water, sulfur acid, Laponite XLS and Carbopol 940. A second premix (Premix 2) was prepared which contained water and the colorant, Direct Yellow 28. A main mix consisting of water, sodium trimetaphosphate, potassium hydroxide, sodium silicate and nonionic was made. The chlorine encapsulates were prepared via the teachings of S/N 688,692, herein incorporated by reference.

Premix 2 was prepared by dispersing 5 parts of Direct Yellow 28 in 95 parts of water. For a one kilogram batch of finished product, 0.6 parts of Premix 2 was used as indicated below.

For a 1 kg. batch of finished product Premix 1 was made wherein 0.2 parts of Laponite XLS was dispersed in 257.3 parts of water, and mixed for 10–15 minutes with mechanical stirring to thoroughly disperse the Laponite. Then 0.6 parts of the colorant prepared as Premix 2 were added to Premix 1, followed by addition of 0.1 parts of sulfuric acid, and 0.9 parts of Carbopol 940. Premix 1 was mixed for at least 40 minutes.

The main mix is prepared by dispersing the sodium trimetaphosphate (STMP) in enough water to provide a good dispersion, which for example 10 represents 133 parts of STMP in 250 parts of water and for example 11, 250 parts of STMP in 281 parts of water. While stirring, the requisite amount of potassium hydroxide was added, at a rate such that the temperature did not exceed 70° C. The liquid silicate (example 10) on solid silicate (example 11) was added next, followed by the addition of the nonionic, Polytergent SLF-18. Perfume and the encapsulated chlorine source were incorporated after the batch temperature was cooled to less than 37° C.

Table 2 compares the potassium to sodium weight ratios for Examples 10–11 with those calculated on the basis of chemical analysis on commercial products "A" and "B" presented as Examples 12 and 13.

TABLE 2

| | | % Sequestrant Anion | | |
|---|---|---|---|---|
| Example No. | Ratio $K^+$ to $Na^+$ | Tripoly | Pyro | Total |
| 10 | 0.831 | 8.41 | — | 8.41 |
| 11 | 1.068 | 15.81 | — | 15.81 |
| 12 Commercial A | 2.943 | 5.36 | 5.95 | 11.31 |
| 13 Commercial B | 0.913 | 12.72 | — | 12.72 |

| | Examples 12–13 | |
|---|---|---|
| | 12 (A) | 13 (B) |
| Sodium Tripolyphosphate | 7.80 | 10.00 |
| Potassium Tripolyphosphate | — | 13.40 |
| Potassium Pyrophosphate | 11.30 | — |
| Potassium Carbonate | 10.80 | — |
| Sodium Silicate, 2.4 r | 5.90 | 9.90 |
| Sodium Hydroxide | — | 1.50 |
| Potassium Hydroxide | 0.20 | — |
| Sodium Hypochlorite | 0.70 | 0.80 |
| Polymer(s) | 2.20 | 0.90 |
| Water & Misc. to | 100% | 100% |
| $K^+/Na^+$ Ratio (Wt. %) | 11.599/3.941 | 6.425/5.84 |
| $K^+/Na^+$, Normalized | 2.943 | 0.909 |

The ratio of $K^+$ to $Na^+$ ion required to stabilize Example 12 was more than two and a half times that required of stabilize examples 10–11 of the instant invention for a comparable amount of sequestrant anion. The ratio of $K^+$ to $Na^+$ for Examples 10–11 was on the order of that present in Example 13, which uses the more costly soluble potassium tripolyphosphate.

EXAMPLES 14–17

The formulations of examples 14–17 below are prepared by the process described for examples 10–11.

| | Examples | | | |
|---|---|---|---|---|
| | 14 | 15 | 16 | 17 |
| Sodium Trimetaphosphate | 10.0 | 20.0 | 10.0 | 13.3 |
| Sodium Silicate, 2.4 r | 12.0 | — | 15.0 | — |
| Sodium Silicate, 2.0 r | — | 9.0 | — | 9.0 |
| Carbopol 940 | 0.90 | .90 | .90 | .90 |
| Sulfuric Acid | .006 | .006 | .006 | .006 |
| Clearon CDB 56[a] | 1.35 | 1.35 | 1.35 | 1.35 |
| Paraffin Wax | 1.34 | 1.34 | 1.34 | 1.34 |
| Hercolyn D[b] | 0.014 | 0.014 | 0.014 | 0.014 |
| Nonionic[c] | 2.0 | 2.0 | 2.0 | 2.0 |
| Potassium Hydroxide | 5.37 | 8.0 | 5.37 | 6.7 |

-continued

| | Examples | | | |
|---|---|---|---|---|
| | 14 | 15 | 16 | 17 |
| Fragrance | 0.10 | 0.10 | 0.10 | 0.10 |
| Laponite XLS | 0.02 | 0.02 | 0.02 | 0.02 |
| Direct Yellow 28 | 0.003 | 0.003 | 0.003 | 0.003 |
| Water | to 100% | to 100% | to 100% | to 100% |
| $K^+/Na^+$ Ratio (Wt. %) | 3.98/5.67 | 5.59/6.78 | 3.75/6.57 | 4.68/5.30 |
| $K^+/Na^+$, Normalized | 0.702 | 0.82 | 0.57 | 0.88 |

[a]sodium dichloroisocyanurate dihydrate supplied by Owen Chemical Company of Hartford, CT

[b]synthetic resin-methyl ester of partially hydrogenated resin from Hercules, Inc. of Wilmington, DE

[c]polytergent SLF-18 supplied by Owen Chemical Company of Hartford, CT

EXAMPLE 18

One of the criteria used to judge the performance of a dishwasher detergent is glassware appearance after washing. In this example, ten dinner plates and ten glass tumblers were placed in a Sears Kenmore dishwasher. Forty grams of a 4:1 mixture of margarine and powdered milk were placed in the dishwasher. The amount of detergent shown in Table 3 was added to the dishwasher dispenser cups; the weight s used equal volumes of powder and liquid. After repeating the test through three wash cycles, glasses were visually inspected, rated and placed in a different dishwasher for three additional washes. The washes and rotation were repeated through four machines for a total of 12 wash cycles. After each set of three washes the glasses were rated numerically for spotting and filming on a scale of 0 to 4 (0=best; 4=worst) for spotting, and 0 to 5 (0=best; 5=worst) for filming. Differences of abut 0.5 in spotting, and 1.0 in filming are considered significant. In Example 18, the spotting and filming scores averaged for the washes obtained for the formula of Example 10 above is compared directly with scores obtained with commercial automatic dishwasher powder (ADP) C. Typical spotting and filming scores for commercial automatic dishwasher liquids (ADL) D and E are included for reference.

TABLE 3

| | | Performance | | | |
|---|---|---|---|---|---|
| Example | Product | GM | % Nonionic | Spotting | Filming |
| 18 | Example 10 | 42 | 2.0 | 1.3 | 0.7 |
| | Commercial ADP C | 26.4 | 2.7 | 0.8 | 0.7 |
| | Commercial ADL D | 42 | — | 2.5 | 1.2 |
| | Commercial ADL E | 39.3 | — | 2.6 | 1.1 |

Since a difference greater than 0.5 in spotting and greater than 1.0 in filming is considered significant, the formula of example 10, one aspect of the invention, is comparable to commercial powder C, and better then commercial liquids D and E in spotting. All four products were equal in filming.

We claim:

1. A homogeneous liquid detergent composition comprising:
(a) about 5 to about 28% by weight of a sodium trimetaphosphate;
(b) about 3 to about 12% by weight of a potassium hydroxide base;
(c) about 2to about 20% by weight of a sodium silicate;
(d) 0 to about 3.0% by weight of a thickening polymer; and
(e) balance water;
wherein the composition contains both sodium and potassium ions in a K+/Na+ weight ratio of about 0.5 and less than 1, is substantially free of added potassium salts and substantially all of the alkaline components (a), (b) & (c) are soluble to form a homogeneous liquid detergent composition.

2. A detergent composition according to claim 1 wherein the sodium silicate has a ratio of $SiO_2$:$Na_2O$ of from about 2 to about 3.2

3. A detergent composition according to claim 1 wherein the sodium trimetaphosphate is present in an amount of about 8 to about 20% by weight.

4. A detergent composition according to claim 1 wherein the thickening polymer has a molecular weight of between 500,000 and 4,000,000 and is present in an amount of about 0.4% by weight to about 1.5% by weight.

5. A detergent composition according to claim 1 wherein the composition further comprises an encapsulated bleach source.

6. A detergent composition according to claim 5 wherein the bleach source is a halogen or peroxygen source.

7. A detergent composition according to claim 6 wherein the halogen source is potassium or sodium dichloroisocyanurate dihydrate.

8. A detergent composition according to claim 1 further comprising about 0.2 to about 8% by weight of a nonionic surfactant.

9. A detergent composition according to claim 1 further comprising one or more optional additives selected for the group consisting of dyes, pigments, perfumes, anti-tarnish agents, soil suspending agents, enzymes, hydrotropes and mixtures thereof, the amount of each additive being up to about 0.5% by weight.

* * * * *